US007182062B2

(12) United States Patent
Beer et al.

(10) Patent No.: US 7,182,062 B2
(45) Date of Patent: Feb. 27, 2007

(54) METHOD FOR CONTROLLING A DIRECT INJECTION OF AN INTERNAL COMBUSTION ENGINE

(75) Inventors: Johannes Beer, Regensburg (DE); Achim Koch, Tegernheim (DE); Harry Schüle, Neunburg V. Wald (DE)

(73) Assignee: Siemens Aktiengesellschaft, Munich (DE)

( * ) Notice: Subject to any disclaimer, the term of this patent is extended or adjusted under 35 U.S.C. 154(b) by 4 days.

(21) Appl. No.: 10/543,603

(22) PCT Filed: Jan. 14, 2004

(86) PCT No.: PCT/EP2004/000220

§ 371 (c)(1),
(2), (4) Date: Jul. 28, 2005

(87) PCT Pub. No.: WO2004/070184

PCT Pub. Date: Aug. 19, 2004

(65) Prior Publication Data

US 2006/0144363 A1 Jul. 6, 2006

(30) Foreign Application Priority Data

Feb. 4, 2003 (DE) ..... 103 04 449

(51) Int. Cl.
*F02D 41/06* (2006.01)
*F02D 41/30* (2006.01)

(52) U.S. Cl. ..... 123/305; 123/491

(58) Field of Classification Search ..... 123/491, 123/305, 435–136, 179.7, 179.12, 179.14
See application file for complete search history.

(56) References Cited

U.S. PATENT DOCUMENTS

| | | | | |
|---|---|---|---|---|
| 3,418,989 | A | 12/1968 | Silverman | |
| 4,766,865 | A | 8/1988 | Härtel | |
| 5,410,253 | A | 4/1995 | Evans et al. | |
| 5,595,161 | A | 1/1997 | Ott et al. | |
| 6,098,585 | A | 8/2000 | Brehob et al. | |
| 6,202,614 | B1 | 3/2001 | Grob et al. | |
| 6,439,190 | B1 * | 8/2002 | Bochum | 123/295 |
| 6,505,602 | B1 * | 1/2003 | Mezger et al. | 123/295 |
| 2005/0087169 | A1 * | 4/2005 | Yoshida et al. | 123/299 |
| 2005/0155568 | A1 * | 7/2005 | Maitani | 123/295 |
| 2006/0060162 | A1 * | 3/2006 | Fukui et al. | 123/179.16 |
| 2006/0137647 | A1 * | 6/2006 | Altenschmidt | 123/299 |

FOREIGN PATENT DOCUMENTS

DE 43 04 163 A1 8/1994

(Continued)

*Primary Examiner*—Hai Huynh

(57) ABSTRACT

The invention relates to a method for controlling an injection of an internal combustion engine. The invention provides that after the internal combustion engine is started, the injection and/or the ignition is carried out according to a signal of an absolute position sensor device, particularly according to an absolute position sensor of a camshaft or according to an absolute position sensor of a crankshaft and to an angular range sensor. When a synchronization signal is detected by a sensor wheel of the crankshaft, the following control processes are carried out according to the synchronization signal, i.e. according to the position of the crankshaft. The inventive method is advantageous in that immediately after the internal combustion engine is started, a relatively precise signal for controlling the injection and/or the ignition is available. This enables a more precise combustion shortly after the internal combustion engine is started.

11 Claims, 7 Drawing Sheets

FOREIGN PATENT DOCUMENTS

| | | |
|---|---|---|
| DE | 198 35 045 C2 | 2/1999 |
| DE | 197 41 294 A1 | 3/1999 |
| DE | 100 32 332 A1 | 1/2002 |
| DE | 100 39 948 A1 | 2/2002 |

* cited by examiner

Absolute position sensor signal
WA
Synch
Sensor signal
LV_SYN_ENG
Signal: crankshaft sensor
Gap in teeth
Stop position range
P1
P2
T5
OT
UT
AT
VT
P
V
A
EV
T1
T2
T3
T4
T6
240 CA
Initial injection
Injection
Intake valve
Outlet valve
1st piston
3rd piston
4th piston
2nd piston
31
33
34
32
t WA
Absolute position sensor
Synch
Sensor
LV SYN ENG
Signal: crankshaft sensor
Gap in teeth
T9
OT
P1
P2
Stop position range
Initial injection
Intake valve
Outlet valve
Injection
T7
T8
T10
T11
240 CA
240 CA
1st piston
3rd piston
4th piston
2nd piston
31
33
34
32
t WA
Absolute position sensor
Synch
Sensor
Stop position range
LV_SYN_ENG
Signal: crankshaft sensor
Gap in teeth
T21
T26
P1
P2
OT
t
1st piston
3rd piston
4th piston
2nd piston
31
33
34
32
First injection High-pressure start
First injection Low-pressure start
Intake valve
Outlet valve
T20
T22
T23
T24
T25
T27
240 CA
240 CA

METHOD FOR CONTROLLING A DIRECT INJECTION OF AN INTERNAL COMBUSTION ENGINE

CROSS REFERENCE TO RELATED APPLICATIONS

This application claims priority to the German application No. 10304449.3, filed Feb. 4, 2003 and to the International Application No. PCT/EP2004/000220, filed Jan. 14, 2004 which are incorporated by reference herein in their entirety.

FIELD & BACKGROUND OF INVENTION

The invention relates to a method for controlling direct injection in an internal combustion engine when the internal combustion engine restarts. For use in modern motor vehicles, it has to be possible to stop the internal combustion engine for a short time and then restart it. This is particularly advantageous when the vehicle is at a red traffic light and the internal combustion engine can be stopped to save fuel and minimize exhaust gas emissions.

SUMMARY OF INVENTION

To manage such frequent stop/start situations, engine/generator combinations are for example used, which can be deployed as a function of the operating state of the internal combustion engine either as an electric motor to start the internal combustion engine or as a generator for the internal combustion engine to produce electrical energy. DE 19 741 294 A1 discloses such a drive system for an internal combustion engine, supporting stop/start operation of the internal combustion engine and using an electric motor to achieve fast automatic operation of the internal combustion engine. When the internal combustion engine is started, the crankshaft is thereby moved to a predefined start position by means of an electrical machine that is enabled during operation of the engine and is coupled in a nonpositive fashion to the crankshaft of the internal combustion engine. Once the crankshaft is in the start position, direct fuel injection is started and the fuel is ignited. The electrical machine transmits a torque to the crankshaft during the entire start process.

DE 19 835 045 C2 discloses a method for starting an internal combustion engine with direct fuel injection and external ignition. The known method has a braking device, which is used to stop the crankshaft of the internal combustion engine in a defined angular position when the internal combustion engine stops. The defined angular position corresponds to a power stroke of a piston of the internal combustion engine, so that the internal combustion engine can be started by the injection of fuel and ignition of fuel in the cylinder of the piston in the power stroke without additional assistance.

DE 10 039 948 A1 discloses a method for starting the internal combustion engine, in which the position of the crankshaft is acquired using a crankshaft sensor and a cylinder just past the top dead center is detected. A fuel/air mixture is blown into the combustion area of the cylinder. Electromagnetically activated intake valves are provided for this purpose. The fuel/air mixture is then ignited so the internal combustion engine can be started without an electrical starter machine. This mode of operation is particularly advantageous during a stop/start operation.

U.S. Pat. No. 4,766,865 discloses an arrangement, which can be used to acquire the angular position of the crankshaft in relation to the cylinders. To this end a signal generator is provided on the crankshaft, the range of which is divided according to the number of cylinders in the internal combustion engine into N/2 signal ranges of equal size. Every signal range has an identifying feature. A signal generator is also arranged on the camshaft, the angular range of which is also divided into N/2 identical signal areas. This arrangement allows the position of the crankshaft to be determined in relation to the cylinders in the internal combustion engine immediately after the internal combustion engine is started.

U.S. Pat. No. 3,418,989 A discloses an electronic ignition system, in which a shaft position sensor is used, to generate a shaft position signal and a time signal used for ignition. The shaft position sensor has n position sensor signals, $2^n$ being equal to the number of cylinders in the internal combustion engine. Three position indicator lines are provided for an 8-cylinder internal combustion engine, to allow eight possible combinations to be acquired for the position of the cylinders in the internal combustion engine.

An object of the invention is to provide an improved method for starting an internal combustion engine.

The object of the invention is achieved by the claims.

One advantage of the method according to the invention is that in addition to a crankshaft sensor, which only acquires a single crankshaft position during one rotation of the crankshaft, an absolute position sensor arrangement is also provided, which is used to acquire the absolute angular position of the camshaft or the crankshaft. After the internal combustion engine is started, injection and/or ignition of the internal combustion engine is controlled as a function of the signal from the absolute position sensor arrangement until a more precise signal has been acquired by the crankshaft sensor for the position of the crankshaft. When the crankshaft sensor acquires the position of the crankshaft, injection and ignition are controlled as a function of the signal from the crankshaft sensor. The absolute position sensor arrangement essentially supplies a less precise signal for the position of the piston in the internal combustion engine compared with the crankshaft sensor. However the precision of this signal is adequate for a start process, to detect a piston either in the intake stroke or in the compression stroke as a function of the signal from the absolute position sensor arrangement. Depending on the phase angles of the pistons it can take a relatively long time for the crankshaft sensor to acquire the position of the crankshaft and therefore for precise determination of the positions of the pistons, i.e. synchronization, to be possible.

In the method according to the invention, fuel is injected into a combustion chamber, the piston of which is in the compression stroke when the internal combustion engine is started. This method is deployed when the fuel pressure is higher than the compression pressure in the combustion chamber during the compression stroke. In internal combustion engines with direct fuel injection the fuel is supplied from a fuel tank, which supplies the fuel at a variable, relatively high pressure. This method has the advantage that a combustion process takes place within the shortest time after the start process of the internal combustion engine, i.e. after movement of the crankshaft, and therefore the internal combustion engine is driven by means of the combustion processes. This minimizes the time for which the starter must drive the internal combustion engine.

With the method according to the invention it is possible to effect injection and/or ignition in a cylinder of the internal combustion engine before piston synchronization. This reduces the time between the initial rotation of the crankshaft and the first injection and first combustion in the internal combustion engine. The internal combustion engine is therefore driven sooner via a combustion process, so the starter used to start the internal combustion engine is only required for a short time. This method can be used in particular with gas engines with direct fuel injection and allows a stop/start functionality to be achieved without major power consumption or extensive use of the starter.

Using a stop/start function makes it possible to stop the engine automatically when the vehicle stops and to restart the engine again automatically when the brake is released, before the driver activates the gas pedal. There is therefore no perceptible delay for the driver during the start process. The synchronization required for the start process between the phase angle of the pistons and injection or ignition becomes available sooner when using the signal from the absolute position sensor than would be possible with the signal from the crankshaft sensor.

Further preferred embodiments of the invention are set out in the dependent claims. In a first preferred embodiment an absolute position sensor for the camshaft is provided as the absolute position sensor arrangement. The absolute position sensor acquires the absolute angular position of the camshaft as soon as the internal combustion engine is started. The absolute angular position of the camshaft can be used approximately to detect the phase angle of the pistons at the start. Corresponding diagrams and/or tables are stored for this purpose.

In a further preferred embodiment an angular range sensor for the camshaft and a second absolute position sensor for the crankshaft are provided as the absolute position sensor arrangement. The angular range sensor detects which of two angular ranges the camshaft is found in during one rotation after the start operation. The second absolute position sensor acquires the absolute angular position of the crankshaft during the start operation. The phase angle of the pistons is determined from a combination of the two signals. Corresponding diagrams and/or tables are stored for this purpose. A combustion chamber of a piston that is in the intake stroke as the internal combustion engine is started is preferably selected as a function of the signal from the absolute position sensor arrangement. Fuel is injected into the combustion chamber of the selected piston during the intake stroke. The injection of fuel into a combustion area, the piston of which is in the intake stroke, has the advantage that the injected fuel is mingled with the air taken in and a relatively clean combustion is achieved with the subsequent ignition.

An ignition process for the combustion area into which the fuel was injected is also preferably started as a function of the signal from the absolute position sensor arrangement. The ignition time for the selected combustion area is thereby determined as a function of the signal from the absolute position sensor arrangement. The ignition process can therefore also be relatively precisely defined by the signal from the absolute position sensor arrangement, even though synchronization has not yet taken place via the crankshaft.

In a further preferred embodiment a sensor is provided for the crankshaft, which acquires the position of the crankshaft at two positions during one rotation of the crankshaft, so that injection and ignition can be synchronized as a function of the position of the crankshaft within a shorter period. The time that has to be covered by the signal from the absolute position sensor is therefore reduced on average.

BRIEF DESCRIPTION OF THE DRAWINGS

The invention is described in more detail below with reference to the figures, in which.

DETAILED DESCRIPTION OF INVENTION

Figure 1:
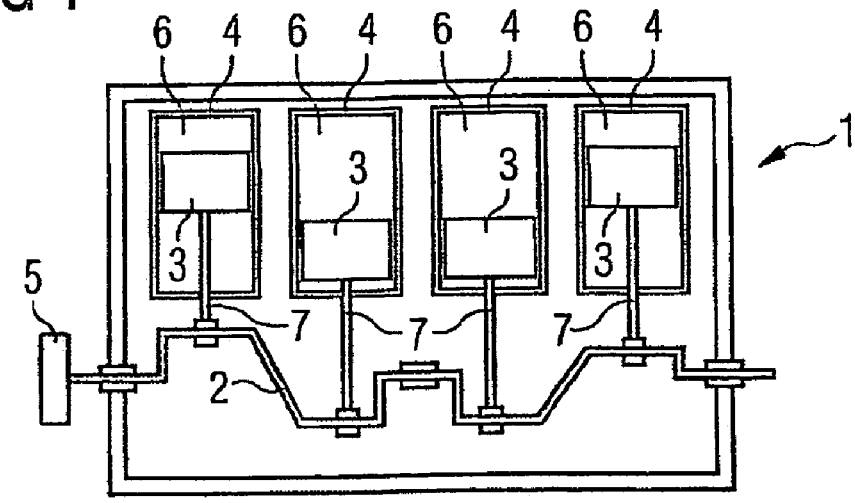
FIG. 1 shows a schematic illustration of an internal combustion engine with a starter generator.

FIG. 1 shows a schematic illustration of an internal combustion engine 1 with a crankshaft 2, connected via connecting rods 7 to four pistons 3. The pistons 3 are guided in a movable fashion in cylinders 4. In a cylinder 4 a piston 3 bounds a combustion chamber 6, in which an air/fuel mixture is introduced and ignited. The crankshaft 2 is supported in a rotatable fashion in a housing of the internal combustion engine and is connected to a starter generator 5. Two pistons 3 at a time are in the same phase. In the example shown the two outer cylinders 3 are close to the top dead center and the two inner cylinders 3 are close to the bottom dead center.

When the internal combustion engine starts, the starter generator 5 is activated. The starter generator 5 thereby causes the crankshaft 2 to rotate, thus causing the cylinders 3 to move up and down in the cylinders 4.

A freewheel system is arranged between the starter generator 5 and the crankshaft 2, so that when combustion starts in the combustion chambers 6 the crankshaft 2 can rotate independently of the rotation of the starter generator 5. After the start process the starter generator 5 is disabled again and the internal combustion engine 1 drives the crankshaft 2 by means of the combustion in the combustion chambers 6. The crankshaft 2 is connected to a drive train (not shown) and drives a motor vehicle in a corresponding fashion.

Figure 2:
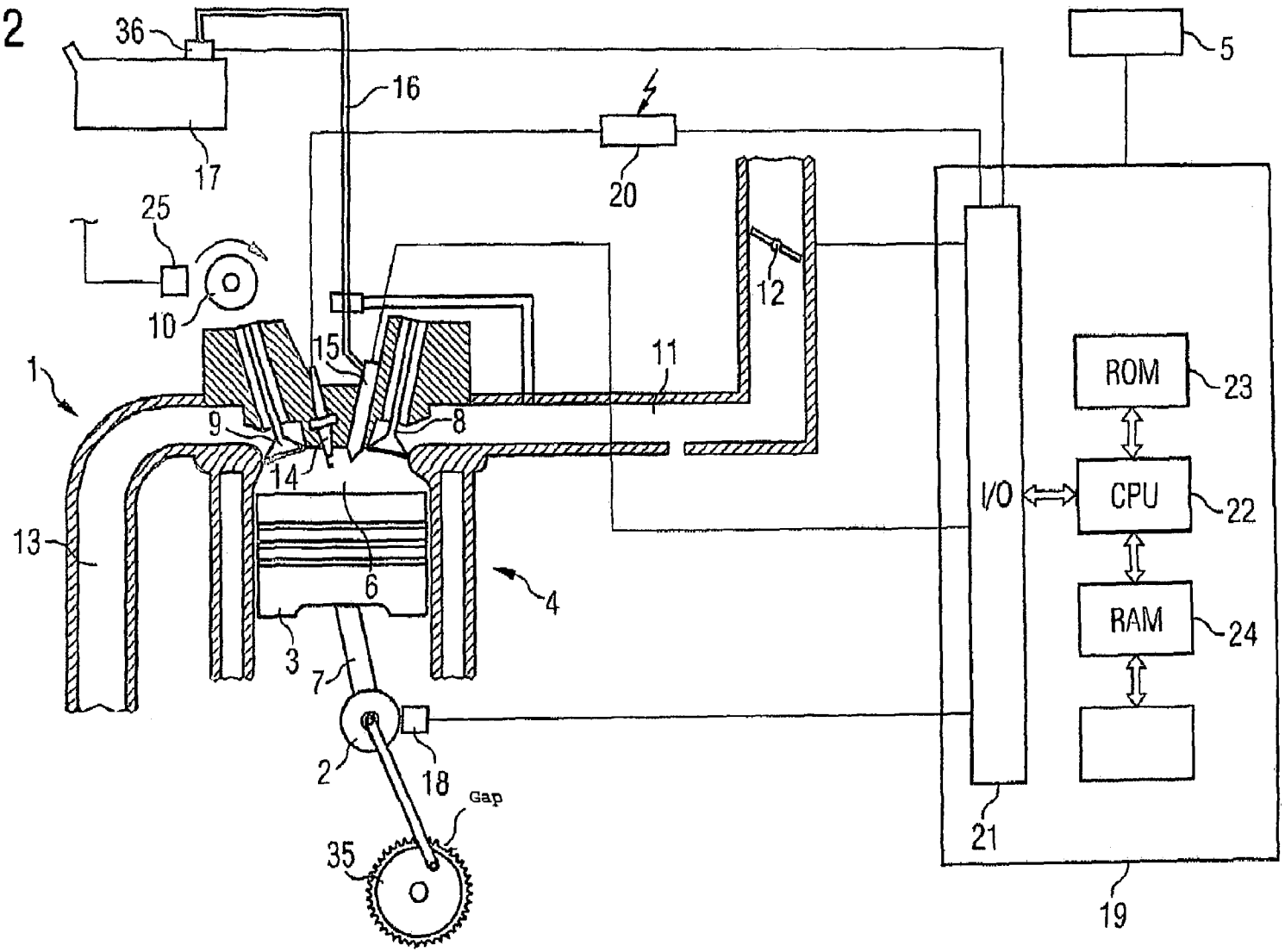
FIG. 2 shows a section of the internal combustion engine with a cross-section through a cylinder.

FIG. 2 shows a schematic cross-section through one of the four cylinders 4 in the internal combustion engine 1. The cylinder 4 has a cylinder head, in which an intake valve 8 and an outlet valve 9 are arranged. The intake valve 8 and the outlet valve 9 are actively connected to a camshaft 10. The camshaft 10 has drive cams, which open and close the intake valve 8 and the outlet valve 9 at defined times. The camshaft 10 is supported in a rotatable fashion in the internal combustion engine 1 and is driven by the crankshaft 2 for example by means of a chain. The intake valve 8 is assigned to an intake opening, which connects the combustion chamber 6 to an intake duct 11. A butterfly valve 12 is arranged in the intake duct 11, to determine the quantity of air taken into the combustion chamber 6 during the intake stroke of a piston 3.

The outlet valve 9 is arranged in an outlet opening, which can connect the combustion chamber 6 to an exhaust gas duct 13. A spark plug 14 and an injection valve 15 are arranged in the cylinder head in addition to the intake and outlet valves 8, 9. The injection valve 15 is connected by means of a fuel line 16 to a fuel storage unit 17. The fuel storage unit 17 is supplied with fuel by a fuel pump. Fuel is stored in the fuel storage unit 17 at a variable pressure, which in the case of a gas-type internal combustion engine with direct fuel injection can reach up to 180 bar as a function of the operating parameters of the internal combustion engine.

The crankshaft 2 is assigned a sensor 18, which acquires a single position of the crankshaft 2 during one rotation of the crankshaft 2. To this end the crankshaft 2 for example has a toothed wheel 36, having 60 teeth, a gap being provided, which is as wide as two teeth ((60-2) toothed wheel). A Hall sensor is also provided, which is arranged in the region of the row of teeth on the toothed wheel and which detects the passage of the gap in the teeth and therefore an absolute rotational position of the crankshaft during rotation of the crankshaft 2.

The sensor 18 is connected to a control device 19. The control device 19 is further connected to the butterfly valve 12, the injection valve 15, an ignition unit 20 and the starter generator 5. The ignition unit 20 is in turn connected via a fuel line to the spark plug 14. The control device 19 has an interface 21 and a central control unit 22. A pressure sensor is also provided on the fuel storage unit 17 and is connected via a signal line to the control device 19. Data can be exchanged via the interface 21 between the sensors and the actuators to be activated, e.g. the starter generator 5 and the ignition unit 20. The central control unit 22 is also connected to a set-value storage unit 23 and a data storage unit 24. The control device 19 is also connected to further sensors, e.g. a gas pedal sensor, which acquires the gas pedal position and therefore the driver's intention. The set-value storage unit 23 is used to store start parameters, methods and characteristics, which the control device 19 can use to control injection processes and ignition processes for the cylinders 4 as a function of operating parameters of the internal combustion engine such as load and rotation speed. The data storage unit 24 is used to store variable parameters, with which optimized control of injection and ignition can be achieved for the combustion processes. An absolute position sensor 25 is assigned to the camshaft 10 as the absolute position sensor arrangement, which acquires the absolute position of the camshaft 10 when the internal combustion engine is started. The absolute position sensor 25 thereby acquires the absolute angular position of the camshaft during one rotation of the camshaft, i.e. an angular value from 0° to 360° camshaft angle. The absolute position sensor 25 is linked to the control device 19.

The control device 19 controls the position of the butterfly valve 12, the quantity of fuel to be injected by the injection valve 15 and the ignition time, at which the spark plug 14 should emit an ignition spark. The fuel pump (not shown) is also controlled by the control device 19, so that the required fuel pressure is present in the fuel storage unit 17.

Figure 3:
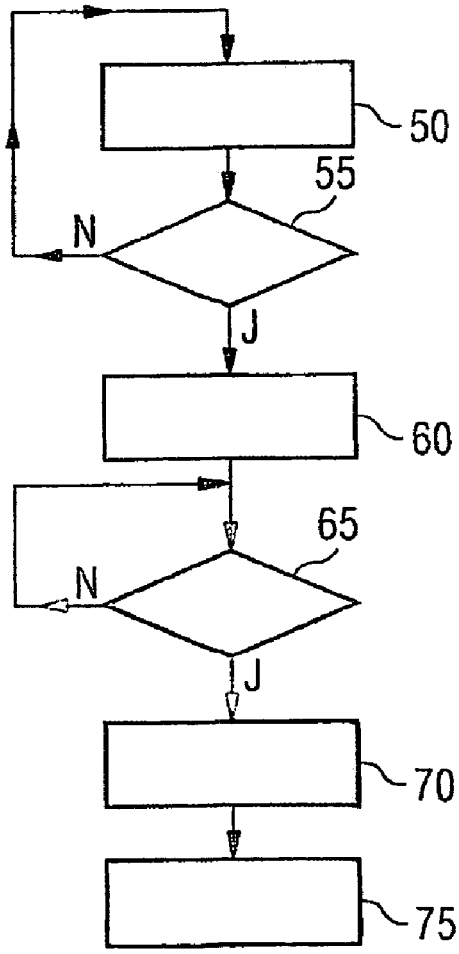
FIG. 3 shows a flow diagram of the method according to the invention.

Operation of the internal combustion engine is described in more detail with reference to the schematic program sequence in FIG. 3. At program point 50 the internal combustion engine 1 controls injection, i.e. the injection time, injection period and the ignition, i.e. the ignition time, as a function of load and rotation speed. At the subsequent program point 55 the control device 19 verifies whether a stop situation exists. A stop situation is identified if the vehicle stops for longer than 1 second with the brake activated. If a stop situation is not established at program point 55, the operation returns to program point 50. If however the control device 19 identifies a stop situation at program point 55, the operation moves to program point 60. At program point 60 the control device 19 terminates injection and ignition processes. No further combustion processes are therefore triggered and the crankshaft 2 comes to a stop. At the same time the information that a stop situation has occurred is preferably stored in the data storage unit 24. At the subsequent program point 65 the control device 19 monitors whether the driver is giving a start signal. A start signal can involve releasing brake activation and activating the gas pedal. If a start signal is identified at program point 65, the operation continues at program point 70. At program point 70 the control device 19 starts operation of the internal combustion engine 1 according to the method according to the invention. To this end the starter generator 5 is first activated so that the crankshaft 2 starts its rotational movement.

At the subsequent program point 75 the control device 19 acquires the absolute angular position of the camshaft 10. At the same time the control device 19 monitors the sensor 18 and awaits identification of the gap in the teeth, indicating the exact angular position of the crankshaft 2 to the control device 19.

In the described start position however the control device 19 does not yet know the angular position of the crankshaft 2, so in the initial period only the signal from the absolute position sensor 25 provides information about the phase angles of the pistons 3. The angular position of the camshaft 10 however provides less precise information about the pistons 3, as the pistons 3 are not connected directly to the camshaft 10 to define the phases permanently. The signal from the absolute position sensor 25 is however adequate to determine an approximate phase angle of the pistons 3. The inaccuracy of the information is accepted for the method according to the invention and fuel injection and fuel ignition are controlled by the control device 19 as a function of the signal from the absolute position sensor 25. If the control device 19 is notified at a later time of the angular position of the crankshaft 2 via the sensor 18, the control device 19 uses the angular position of the crankshaft 2 for further injection and/or ignition processes, to determine the phase angle of the pistons 3. Diagrams and/or tables are stored [in the set-value storage unit 23] both for the angles of the camshaft and for the angular position of the crankshaft and these can be used by the control device to determine the phase angles of the pistons.

The exact angular position of the crankshaft 2 determines precisely the phase angles of all pistons 3 in the internal combustion engine 1. If the control device 19 knows the current angular position of the crankshaft 2, the control device 19 also knows the current phase angles of the pistons 3. The phase of the pistons 3 is determined via the connecting rod 7 in respect of the crankshaft 2. For this precise determination of the injection time and the injection period and for the precise determination of the ignition time the control device 19 requires the precise phase angle of the corresponding piston 3.

Different embodiments of the method according to the invention are described in more detail with reference to FIGS. 4 to 6.

Figure 4:
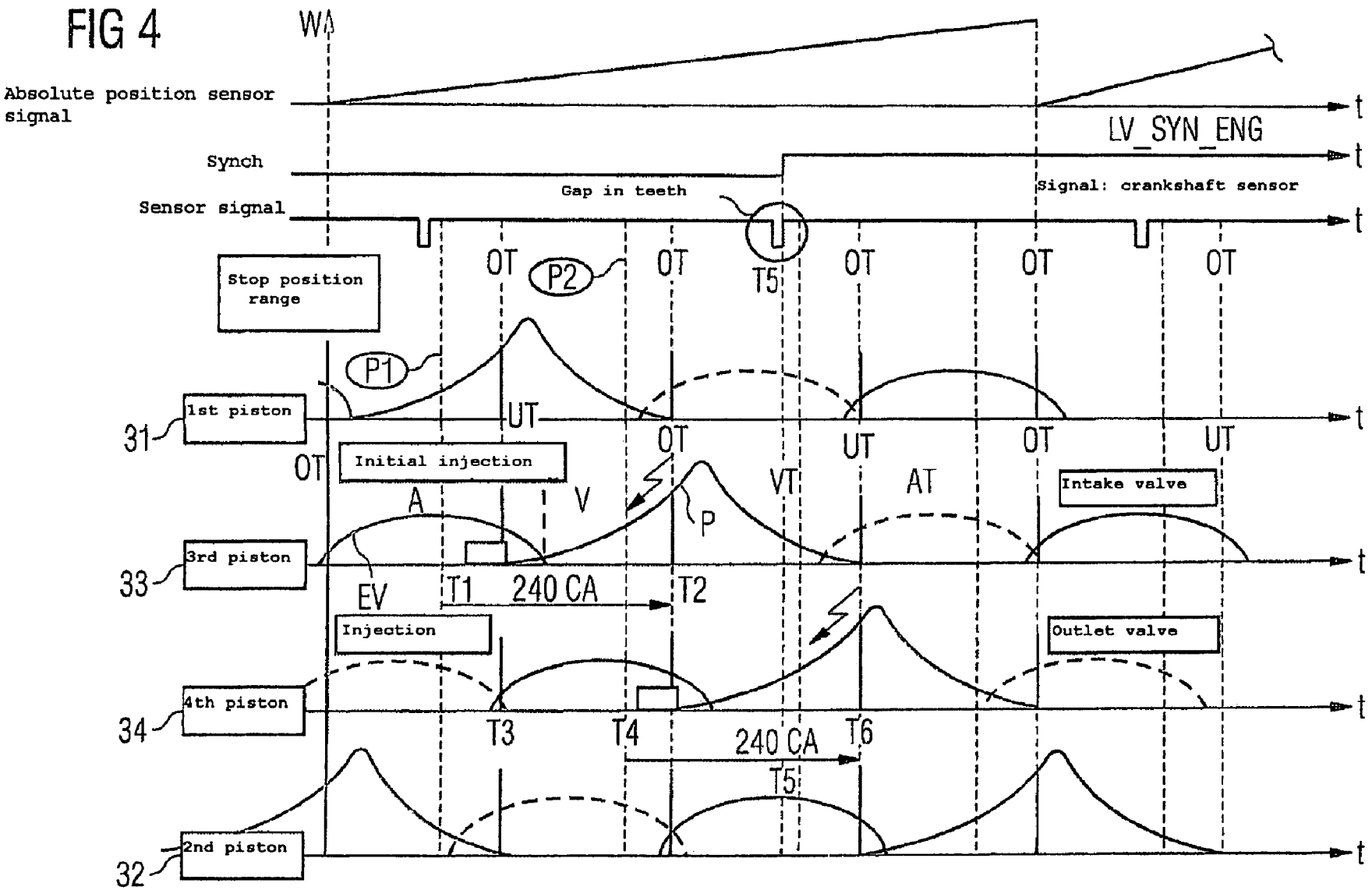
FIG. 4 shows a first diagram describing the method according to the invention.
Figure 5:
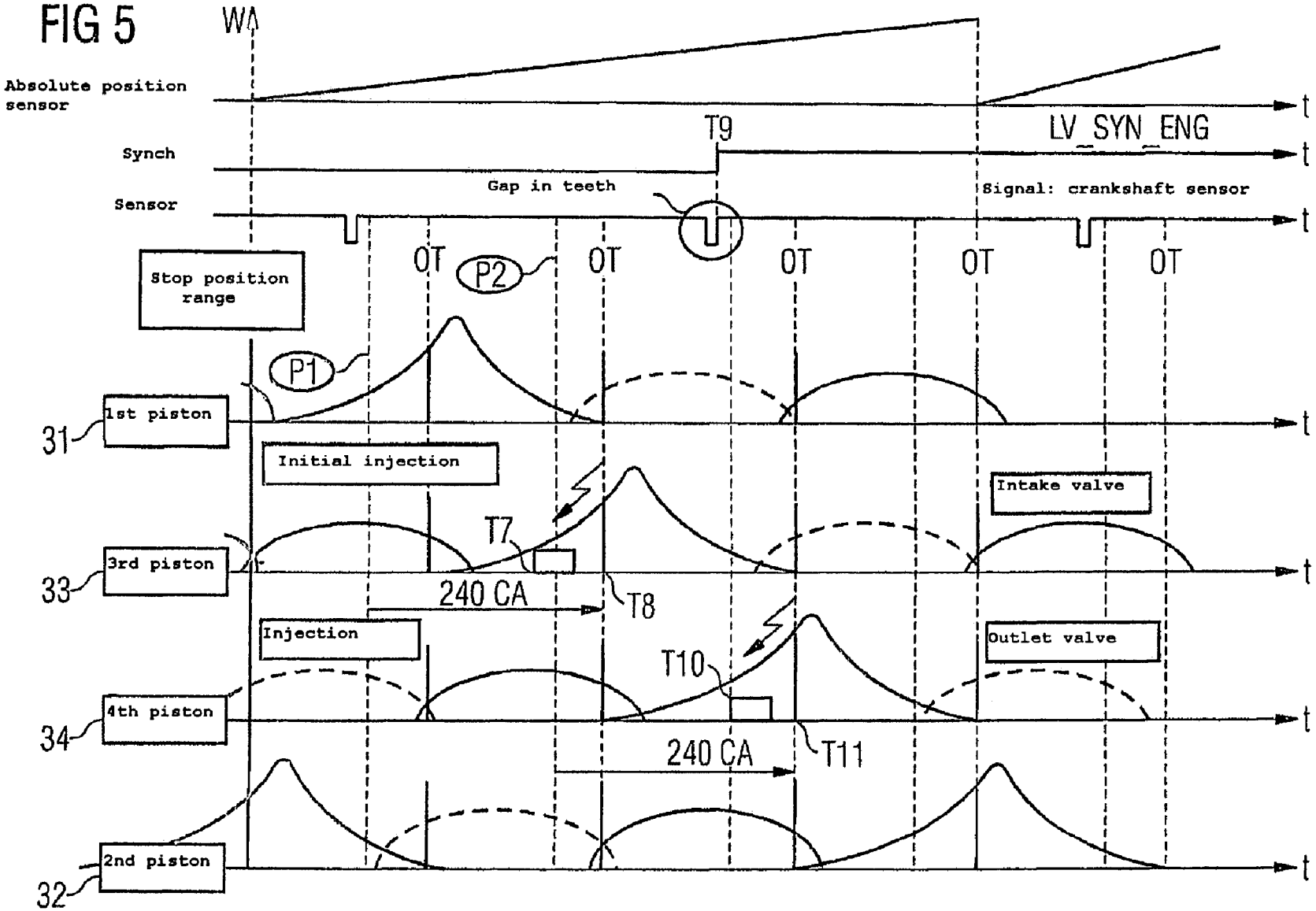
FIG. 5 shows a second diagram describing the method according to the invention during a high-pressure start operation.

FIG. 4 shows a first diagram, in which the signal from the absolute position sensor 25, a synchronization signal synch from the control device 19, the signal from the sensor 18 and the phase angles of four pistons 3 are shown as a function of the time t. In the case of a four-stroke internal combustion engine two full rotations of the crankshaft and one rotation of the camshaft are required for a full power stroke. The absolute position sensor 25 emits an angle signal W, which indicates the angular position from 0° to 360° of the camshaft 10 over one rotation. One rotation of the camshaft 10 covers all four power strokes of a piston during two rotations of the crankshaft 2. A first phase diagram 31 of a first piston in the internal combustion engine is thereby shown directly below the signal from the sensor 18. A third phase diagram 33 of a third piston in the internal combustion engine is shown below the first phase diagram 31. A fourth phase diagram 34 of a fourth piston in the internal combustion engine is shown below that. A second phase diagram 32 of a second piston in the internal combustion engine over time is shown last. The same symbols are used to show the phase states for the four pistons.

In the third phase diagram 33 the phase diagram starts with a bold solid line, which symbolizes the lift of an intake valve 8. As the intake valve 8 opens, air is taken into the combustion chamber 6 of the third cylinder of the third piston via the intake valve 8. The third piston is thereby in an intake stroke A. Once the intake valve 8 has closed, a compression stroke V starts, shown in the third phase diagram 33 after the intake stroke in the form of a steeply rising pressure characteristic P. The pressure characteristic represents the pressure in the combustion chamber of the third cylinder. The compression stroke V goes up to a top dead center OT, shown as a broken vertical line in the third phase diagram 33. Ignition takes place in the region of the top dead center OT, shown schematically in the form of a lightning flash. A combustion stroke VT follows the top dead center OT. During the combustion stroke the pressure in the combustion chamber 6 rises further shortly after the top dead center OT, as shown in the third phase diagram 33. However the third piston thereby moves back down so the pressure in the combustion chamber drops again after reaching a maximum. During the combustion stroke VT a drive train of the internal combustion engine 1 is driven via the crankshaft 2. The combustion stroke VT is followed by a discharge stroke AT, during which the exhaust gas generated in the combustion chamber 6 during the combustion stroke VT is discharged. The lift of the outlet valve 9 during the discharge stroke is shown. At the next top dead center OT the outlet valve 9 is closed again and the intake valve 8 is opened. Air is thus taken in once again during an intake stroke A.

The phase sequences of the four pistons are all identical, the phases of the individual pistons being offset by half a crankshaft rotation in respect of each other. For a full combustion process with the intake stroke A, the compression stroke V, the combustion stroke VT and the discharge stroke AT, in the case of a four-stroke internal combustion engine the crankshaft is rotated through two full rotations. In contrast the camshaft 10 only rotates through one rotation. It is assumed below that when it is started, the internal combustion engine 1 is in a first position P1. The first position P1 is shortly after the sensor 18 passes the gap in the teeth in the toothed wheel 35. If the internal combustion engine 1 is started in the first position P1, the control device 19 identifies from the signal from the absolute position sensor 25 that the first piston, the phase angle of which is shown in the first phase diagram 31, is in a compression stroke V, the third piston, the phase angle of which is shown in the third phase diagram 33, is in an intake stroke A, the fourth piston, the phase angle of which is shown in the fourth phase diagram 34, is in a discharge stroke AT and the second piston, the phase angle of which is shown in the second phase diagram 32, is in a combustion stroke VT. As the control device 19 has not yet received a synchronization signal Synch, the signal from the absolute position sensor 25 is used to control injection. The control device 19 also compares the pressure of the fuel in the fuel storage unit 17 and identifies that the pressure in the fuel storage unit 17 is lower than the pressure occurring during compression by the third piston. A low-pressure situation therefore exists. In the case of a low-pressure situation the control device 19 issues a control command to the injection valve 15, which is assigned to the combustion chamber of the third piston, so that fuel is injected into the combustion chamber of the third cylinder at a first time T1 during the intake stroke.

The injection process at the first time T1 is shown in the third phase diagram 33 in the form of a rectangular surface. The compression stroke V follows the end of the intake stroke A of the third piston and at a second time T2 the control device 19 emits a signal to the ignition unit 20 so that ignition is triggered in the combustion chamber of the third piston at the second time T2. The second time T2 is in the region of the top dead center of the third piston. At this time the control device 19 still has no further information about the exact phase angles of the pistons, as the sensor 18 has not yet identified the gap in the teeth. After ignition the fuel combusts in the combustion chamber of the third cylinder during the combustion stroke VT. The exhaust gas is then discharged via the outlet valve 9 during a discharge stroke AT after the next bottom dead center UT.

Parallel to this after the first time T1 the control device identifies that the fourth cylinder of the fourth piston, the phase angle of which is shown in the fourth phase diagram 34, is in an intake stroke A from a third time T3. The control device 19 therefore emits a signal to the injection valve 15, which is assigned to the fourth cylinder of the fourth piston, to start an injection process at a fourth time T4. The fourth time T4 is still within the intake stroke A of the fourth cylinder. At a subsequent fifth time T5 the sensor 18 detects the gap in the teeth of the toothed wheel 35, so that a synchronization signal Synch is emitted to the control device 19. On receipt of the synchronization signal the control device 19 controls all further processes according to the phase angle of the crankshaft 2. Ignition for the fourth cylinder, which takes place at a later sixth time T6, is therefore controlled by the control device 19 at the sixth time T6 as a function of the synchronization signal from the sensor 18. All further processes for further injections or ignition processes are also controlled by the control device 19 as a function of the synchronization signal from the sensor 18.

Information about the angular position of the crankshaft 2 has the advantage that the phase angles of the pistons can be determined precisely in relation to the rotational position of the crankshaft 2. The advantage of the method according to the invention is however that if the internal combustion engine is started in the time ranges in which a synchronization signal from the sensor 18 has not yet been acquired, injection and/or ignition is/are controlled by the control device 19 as a function of the signal from the absolute position sensor 25. The absolute position sensor 25 emits a signal for the angular position of the camshaft 10, acquiring an angle value over two crankshaft rotations. The phase angles of the individual cylinders of the internal combustion engine can therefore be determined based on the signal from the absolute position sensor 25. The camshaft 10 is for example connected in respect of phase via a drive chain to the crankshaft 2 and therefore to the phase angles of the pistons. The phase angles of the pistons can therefore be determined with relative accuracy using the angle signal from the absolute position sensor 25.

If the internal combustion engine is started in a second position P2, the control device 19 identifies from the signal from the absolute position sensor 25 that the first piston, the phase angle of which is shown in the first phase diagram 31, is in a combustion stroke VT, the third piston, the phase angle of which is shown in the third phase diagram 33, is in a compression stroke V, the fourth piston, the phase angle of which is shown in the fourth phase diagram 34, is in an intake stroke A and the second piston, the phase angle of which is shown in the second phase diagram 32, is in a discharge stroke AT. The control device 19 therefore selects the fourth cylinder of the fourth piston to inject fuel into the combustion chamber of the fourth cylinder via the injection valve 15 at a fourth time T4. At a sixth time T6 the fuel/air mixture is then ignited in the fourth cylinder by the control device 19 as a function of the synchronization signal Synch, which was acquired at the fifth time T5.

A start method for an internal combustion engine, in which the fuel in the fuel storage unit 17 is at a higher pressure than is generated in the combustion chambers 6 during compression in a compression stroke, is described with reference to FIG. 5. If the internal combustion engine 1 is now started in the first position P1, the control device 19 identifies from the signal from the absolute position sensor 25 that the third piston, the phase angle of which is shown in the third phase diagram 33, is in an intake stroke A. The control device 19 selects the third cylinder of the third piston and injects fuel into the combustion chamber of the third piston via the injection valves 15 at a seventh time T7 during a subsequent compression stroke V. As the fuel is at a higher pressure than the compression pressure, the fuel can be injected during the compression stroke V at the seventh time T7. Injection is once again shown in the form of a rectangle. At a subsequent eighth time T8 the control device 19 ignites the air/fuel mixture in the combustion chamber of the third cylinder based on the signal from the absolute position sensor in the region of the top dead center during the transition from the compression stroke V to the combustion stroke VT.

If the internal combustion engine 1 is started in the second position P2, the control device 19 identifies from the signal from the absolute position sensor 25 that the fourth piston, the phase of which is shown in the fourth phase diagram 34, is in an intake stroke A. At a subsequent tenth time T10 the control device therefore controls injection into the combustion chamber of the fourth piston during a compression stroke. The tenth time T10 is after the ninth time T9, when a synchronization signal was sent from the sensor 18 to the control device 19. The injection point, i.e. the tenth time T10, is however so close to the ninth time T9 that it is no longer possible to calculate and control the injection time based on the synchronization signal from the sensor 18. Subsequent ignition in the fourth cylinder at an eleventh time T11 close to the next top dead center OT of the fourth piston takes place later than a calculation time after the synchronization signal Synch. Thus in this constellation only the injection process is controlled as a function of the signal from the absolute position sensor 25 and the next ignition process is controlled as a function of the signal from the sensor 18.

Figure 6:
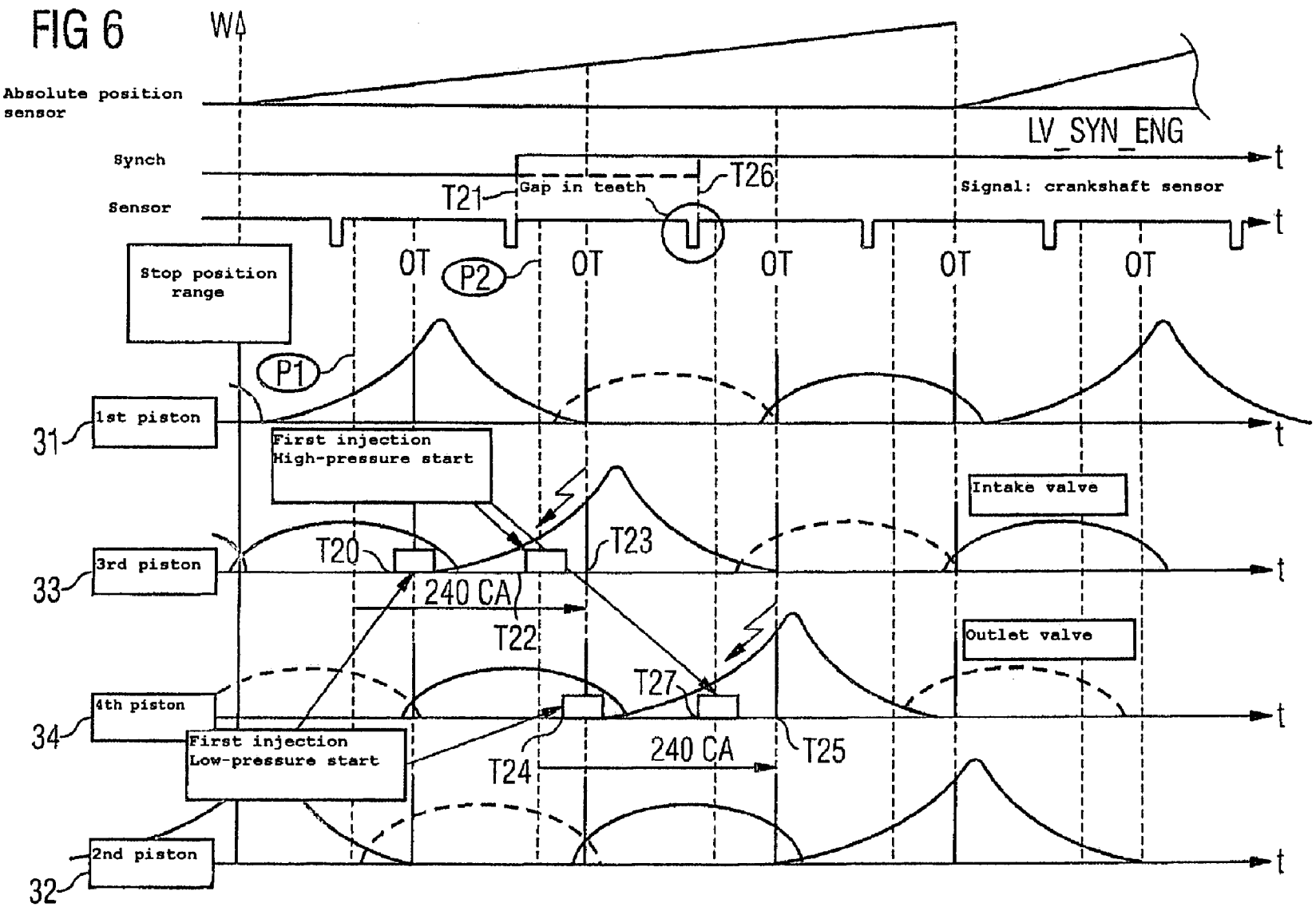
FIG. 6 shows a third diagram describing the method according to the invention with a sensor wheel with two gaps in the teeth.

FIG. 6 shows a further embodiment of the method according to the invention, in which a sensor 18 is used with a second toothed wheel, which has two gaps in its teeth, arranged at an offset of 180° from each other. With this arrangement therefore the sensor 18 detects two gaps in the teeth during a single rotation of the crankshaft 2. Therefore after the start process the maximum interval between the internal combustion engine 1 starting up and a synchronization signal being obtained is limited to a 180° crankshaft angle. A reliable signal for controlling injection and ignition is therefore obtained within a shorter period with this embodiment.

If the internal combustion engine 1 is started in the first position P1 and the pressure of the fuel in the fuel storage unit 17 is lower than the compression pressure during the compression processes in the combustion chambers 6, the control device 19 identifies from the signal from the absolute position sensor that the third piston, the phase angle of which is shown in the third phase diagram 33, is in an intake stroke A. Therefore at a twentieth time T20 the control device 19 injects fuel into the combustion chamber 6 of the third cylinder of the third piston in the intake stroke. The injection process is shown symbolically in the form of a rectangle. At this time no synchronization has yet been received by the control device 19. At a $21^{st}$ time T21 the control device 19 acquires a synchronization signal Synch. from the sensor 18. Ignition, which takes place at a $23^{rd}$ time T23, is controlled by the control device 19 as a function of the synchronization signal Synch. from the sensor 18 and therefore as a function of the rotational position of the crankshaft 2.

If the pressure of the fuel in the fuel storage unit 17 is at a higher pressure than the compression pressure in the combustion chambers 6, when the internal combustion engine 1 is started in the first position P1 the control device 19 identifies that the third piston is in an intake phase. Because of the high fuel pressure, the control device 19 controls injection at a $22^{nd}$ time T22 during the subsequent compression phase of the third piston. The $22^{nd}$ time T22 follows temporally shortly after the $21^{st}$ time T21, at which the synchronization signal of the sensor 18 was generated. However the short interval means that it is no lon ger possible to control injection as a function of the synchronization signal. Therefore in this instance injection at the $22^{nd}$ time T22 is controlled by the control device 19 as a function of the signal from the absolute position sensor. The subsequent ignition, which is effected at a $23^{rd}$ time T23 close to the top dead center of the third piston, is controlled by the control device 19 as a function of the synchronization signal Synch from the sensor 18.

If the internal combustion engine 1 is now started in the second position P2, the phase angle of the fourth piston, which is shown in the fourth phase diagram 34, is identified as an intake stroke. At a $24^{th}$ time T24 the control device 19 controls injection into the combustion chamber 6 of the fourth piston during the same intake stroke based on the signal from the absolute position sensor 25. Injection is shown schematically in the form of a rectangle. Ignition, which is carried out by the control device 19 at a subsequent $25^{th}$ time T25 close to the next top dead center OT, is controlled as a function of the synchronization signal Synch, received at a $26^{th}$ time T26 from the sensor 18.

If the internal combustion engine 1 is started in the second position P2 and the fuel in the fuel storage unit 17 is at a pressure above the compression pressure, the control device 19 identifies from the signal from the absolute position sensor 25 that the fourth piston is in the intake stroke. However as the fuel pressure is above the compression pressure, injection is only carried out in the next compression stroke of the fourth piston at a $27^{th}$ time T27. The $27^{th}$ time T27 is shortly after the $26^{th}$ time T26, when the sensor 18 transmits a synchronization signal Synch to the control device 19. However the time interval between the synchronization signal Synch and the $27^{th}$ time T27, i.e. the injection time, is too short with the result that it is not possible to recalculate on the basis of the synchronization signal and therefore the control device 19 carries out injection at the $27^{th}$ time T27 as a function of the signal from the absolute position sensor 25.

On receipt of the synchronization signal, the control device 19 verifies whether the time remaining until a control process, e.g. injection or ignition, is longer than a defined calculation time. If the time interval is shorter than the defined calculation time, the process to be carried out is carried out as a function of the signal from the absolute position sensor 25, even though a synchronization signal is present. If however the time interval between receipt of the synchronization signal and the time when the control is to be carried out is longer than the calculation time, the control device 19 calculates the time of the action to be carried out as a function of the synchronization signal. This ensures that on receipt of the synchronization signal all the controls to be carried out by the control device 19 are calculated and carried out as a function of the more precise synchronization signal Synch.

Figure 7:
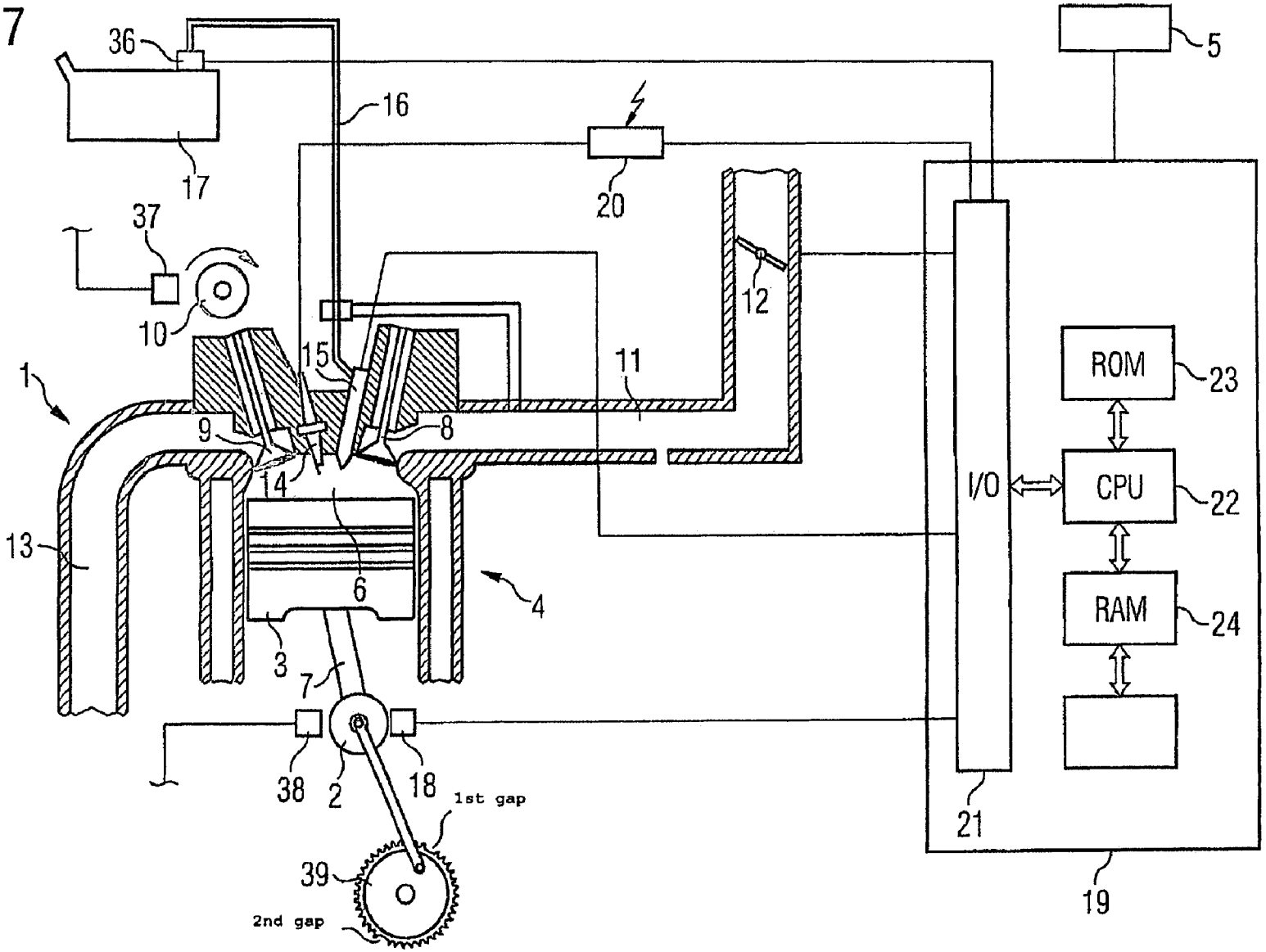
FIG. 7 shows a further embodiment of an internal combustion engine and FIG. 8 shows a fourth diagram describing the method with the assistance of the second embodiment.

FIG. 7 shows a further embodiment of an internal combustion engine, in which an angular range sensor 37 and a second absolute position sensor 38 are provided as the absolute position sensor arrangement. The arrangement in FIG. 7 corresponds essentially to the arrangement in FIG. 2, but with an angular range sensor 37 assigned to the camshaft 10 instead of the absolute position sensor 25 and the second absolute position sensor 38 also being assigned to the crankshaft 2. When the internal combustion engine is started, the angular range sensor 37 acquires one of two angular ranges of one rotation of the camshaft 10. One rotation of the camshaft is thereby divided into a first angular range from 0 to 180° and a second angular range from 180 to 360°. If the internal combustion engine is started, the angular range sensor 37 immediately identifies whether the camshaft is in the first angular range or in the second angular range.

When the internal combustion engine is started, the second absolute position sensor 38 acquires the absolute angular position of the crankshaft 2. Both the angular range sensor 37 and the second absolute position sensor 38 are connected to the control device 19. In the embodiment shown in FIG. 7 a second toothed wheel 39 is provided, having 58 toothed wheels (60-2-2 toothed wheel) and two gaps in the teeth at an offset of 180° from each other, the width of said gaps each corresponding to the width of two teeth. A toothed wheel 35 according to the embodiment in FIG. 2 can also be used instead of the embodiment with a second toothed wheel 39 shown in FIG. 7.

Figure 8:
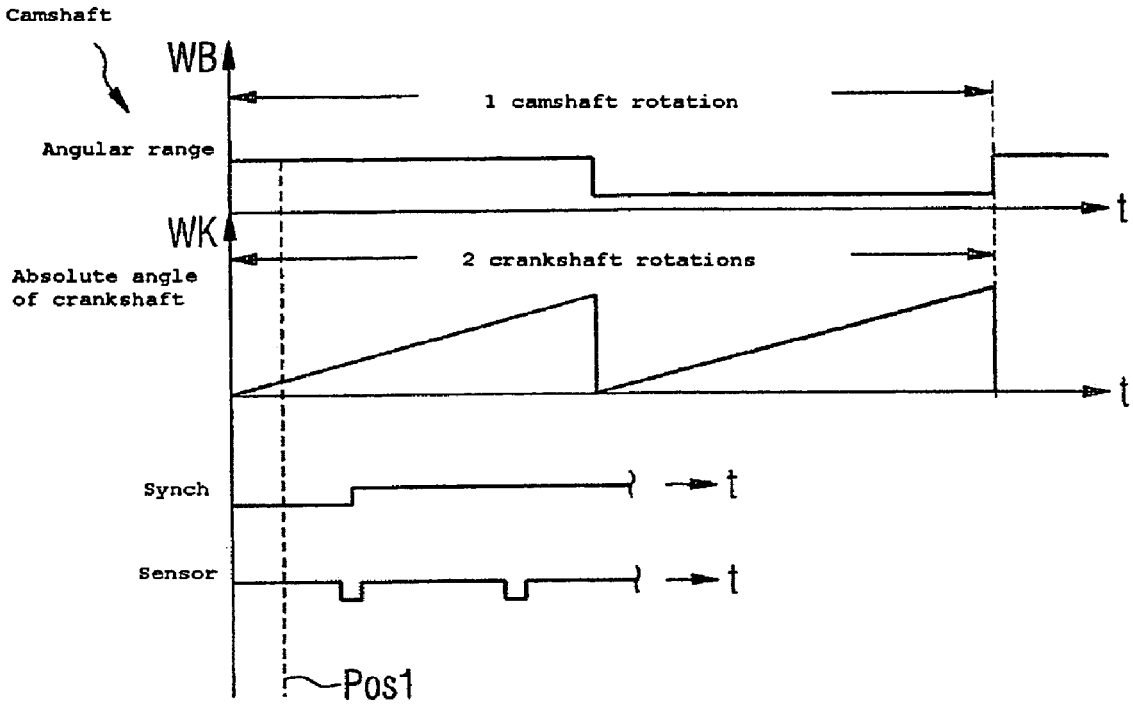

In a fourth diagram, FIG. 8 shows the signals from the angular range sensor 37, the signal from the second absolute position sensor 38, the signal from the sensor 18 with the second toothed wheel 39 and the corresponding synchronization signal. The other phase diagrams for the first, second, third and fourth pistons are arranged in the same way as the diagrams in FIGS. 4, 5 and 6 but are not described in further detail for the sake of simplicity. If the internal combustion engine 1 is now started in a first position P1, no signal is as yet available from the sensor 18 and therefore there is no synchronization signal Synch for the control device 19. When the internal combustion engine is started, the control device 19 uses the evaluation of the signal WB from the angular range sensor 37 and the signal from the second absolute position sensor 38 to acquire the corresponding phase angles of the four pistons. The combination of the absolute angle WK of the crankshaft 2 and the high or low signal from the angular range sensor 37 allows the control device 19 to determine the phase angles of the four pistons. To this end corresponding tables and diagrams, as shown in FIGS. 4 to 6, are stored in the set-value storage unit 23. When selecting the cylinder, into which fuel is to be injected and in which the injected fuel is then to be ignited, the control device 19 proceeds according to the same rules as already described with reference to FIGS. 4 to 6. The only difference is that to determine the phase angle, until a position signal for the crankshaft 2 is transmitted from the sensor 18 to the control device 19, the control device 19 acquires the phase angles of the pistons as a function of the signal from the angular range sensor 37 and as a function of the signal from the second absolute position sensor 38.

The invention claimed is:

1. A method of controlling direct injection of fuel into a combustion chamber of an internal combustion engine, the internal combustion engine having a plurality of combustion chambers, each combustion chamber limited by a movable piston, the pistons connected to a crankshaft, wherein intake and outlet valves are arranged on the combustion chambers, the intake and outlet valves activated by a camshaft, the method comprising:

acquiring a phase angle of the pistons at the time of starting up the internal combustion engine, by a absolute position sensor arrangement configured to acquire an absolute position of the pistons, the absolute position sensor arrangement assigned to the camshaft or the crankshaft;

verifying if a fuel pressure is greater than a compression pressure;

if the verification is positive, selecting such combustion chamber the piston of which first enters compression stroke after starting up the combustion engine based on a position signal generated by the absolute position sensor arrangement;

injecting fuel into the selected combustion chamber during the compression stroke;

controlling direct injection based on the position signal generated by the position sensor arrangement;

acquiring a single position of the crankshaft during a full rotation of the crankshaft, by a sensor;

determining the phase angle of the pistons using a position signal originating from the sensor after the single position of the crankshaft has been acquired by the sensor; and controlling the direct injection or ignition based on the acquired single position of the crankshaft.

2. The method according to claim 1, wherein the absolute position sensor arrangement includes a first absolute position sensor configured to acquire an absolute angular position of the camshaft, and the direct injection is controlled based on an angular position signal generated by the position sensor before the single position of the crankshaft is acquired.

3. The method according to claim 1, wherein the absolute position sensor arrangement includes:

an angular range sensor for acquiring one of two angular ranges of the camshaft;

a second absolute position sensor configured to acquire an absolute angular position of the crankshaft, wherein determining the phase angles of the pistons and controlling the injection are based on the acquired angular range and the acquired angular position of the crankshaft before the single position of the crankshaft is acquired.

4. The method according to claim 1, further comprising:

selecting such combustion chamber the piston of which first enters intake stroke after starting up the combustion engine based on the position signal generated by the absolute position sensor arrangement; and injecting fuel into the selected combustion chamber.

5. The method according to claim 1, wherein ignition is triggered based on the position signal generated by the absolute position sensor arrangement.

6. The method according to claim 1, further comprising acquiring a further position of the crankshaft during the full rotation of the crankshaft, by the sensor.

7. The method according to claim 5, wherein the position has a phase difference of 180° relative to the further position during the one rotation.

8. The method according to claim 1, wherein upon acquisition of the position of the crankshaft, injection or ignition is calculated based on the position of the crankshaft if an injection or ignition time is later than a calculation time after the acquisition of the position of the crankshaft by the sensor.

9. An internal combustion engine, comprising:

a plurality of cylinders having pistons limiting a plurality of combustion chambers;

a plurality of injection valves;

a camshaft;

a plurality of intake and outlet valves drivable by the camshaft;

a crankshaft connected to the pistons;

a sensor for acquiring an angular position of the crankshaft;

a control device for controlling injection; and an absolute position sensor arrangement for acquiring phase angles of the pistons when the internal combustion engine is started, the absolute position sensor arrangement connected to the control device, the control device configured to control the injection based on a position signal generated by the absolute position sensor arrangement before and until the sensor acquires the angular position of the crankshaft, wherein the control device is configured to:

control the injection based of a signal generated by the sensor upon acquisition of the angular position of the crankshaft by the sensor, select such combustion chamber based on the position signal generated by the absolute position sensor arrangement, the piston of which combustion chamber is in a compression stroke after starting the engine, if a fuel pressure is greater than a compression pressure, and inject fuel into the selected combustion chamber during the compression stroke.

10. The internal combustion engine according to claim 9, wherein the absolute position sensor arrangement includes a first absolute position sensor assigned to the camshaft and configured to acquire an absolute angular position of the camshaft, and the control device is further configured to:

control fuel injection after starting the combustion engine based on an angular position signal generated by the first absolute position sensor until the sensor acquires the angular position of the crankshaft; and control fuel injection upon acquisition of the angular position by the sensor and thereafter based on the angular signal acquired by the sensor.

11. The internal combustion engine according to claim 9, wherein the absolute position sensor arrangement comprises an angular range sensor and a second absolute position sensor, the angular range sensor assigned to the camshaft and configured to acquire one of two angular ranges of the camshaft during one rotation of the camshaft, the second absolute position sensor assigned to the crankshaft and configured to acquire an absolute angular position of the crankshaft, the angular range sensor and the second absolute position sensor operatively connected to the control device, and the control device is configured to:

acquire a phase angle of the pistons using an angular position signal generated by the angular range sensor and a position signal generated by the second absolute position sensor when the internal combustion engine is started, and to control the injection until the sensor acquires the position of the crankshaft.

* * * * *